US007189135B2

(12) United States Patent
Chiang

(10) Patent No.: US 7,189,135 B2
(45) Date of Patent: Mar. 13, 2007

(54) UNDERWATER FUN TOY

(76) Inventor: Herman Chiang, 11 F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 46 days.

(21) Appl. No.: 11/037,363

(22) Filed: Jan. 19, 2005

(65) Prior Publication Data

US 2006/0160632 A1 Jul. 20, 2006

(51) Int. Cl.
*A63H 23/12* (2006.01)
*A63H 23/00* (2006.01)

(52) U.S. Cl. ..... 446/156; 446/160; 273/350

(58) Field of Classification Search ..... 446/153, 446/156, 160, 161, 491, 71, 124; 473/466; 472/13, 128; 482/55, 148; 273/350, 445, 273/446

See application file for complete search history.

(56) References Cited

U.S. PATENT DOCUMENTS 1,258,862 A * 3/1918 Bloom ..... 446/161
4,198,780 A * 4/1980 Kubiatowicz ..... 446/156
4,689,032 A * 8/1987 Trossman ..... 446/160
6,913,505 B1 * 7/2005 Chiang ..... 446/153

* cited by examiner

*Primary Examiner*—Kien Nguyen
(74) *Attorney, Agent, or Firm*—Troxell Law Office PLLC

(57) ABSTRACT

An underwater fun toy includes a buoyant body having an upper and lower surface and a receiving portion communicating through the upper and lower surface, an underwater member receivable in the receiving portion having a first and second surface, first and second engaging portions formed on the receiving portion and the underwater member, and a plurality of stand portions for supporting the buoyant body which engages with the underwater member at a desired height from the bottom of water. The first and second engaging portions are engageable with each other and disengageable from each other, wherein in use the buoyant body engages the underwater member and is sank in water such that stand portions keeps the buoyant body at a desired height above the bottom of water, and when the underwater member is depressed to disengage from the buoyant body thereby said buoyant body floats to the surface of the water and the underwater member remains sank.

12 Claims, 5 Drawing Sheets

UNDERWATER FUN TOY

TECHNICAL FIELD

The present invention relates to a fun toy, and particularly to an underwater fun toy having a buoyant body for floating on water after the fun toy is depressed at an underwater member.

BACKGROUND

Swimming is not only one kind of wonderful sports but also one kind of activities for taking a summer holiday. More and more aquatic games are made and designed for fun, such as holding one's breath under water, walk race in water, treasure hunt under water, ball games in water and so on.

A conventional game of treasure hunt under water is that a coin is thrown in water and swimmers dive into water to look for the coin. The guy who first finds the coin is the winner. However, it is monotonous to look for a coin under the water and it is inconvenient to pick up a coin under the water since the coin is quite small.

DESCRIPTION OF THE PREFERRED EMBODIMENT

Figure 1:
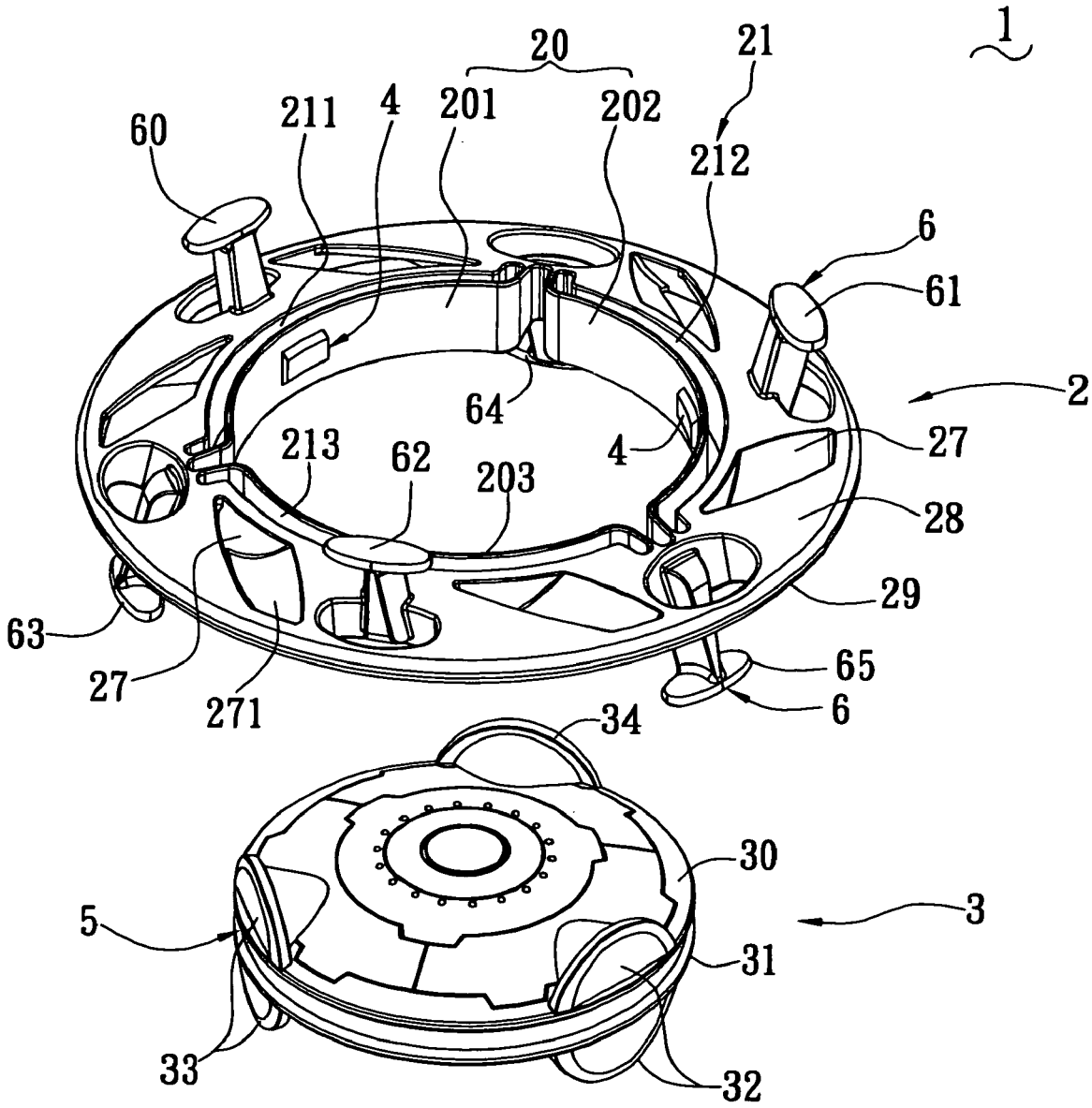
FIG. 1 is an exploded view of an underwater fun toy of the present invention.
Figure 2:
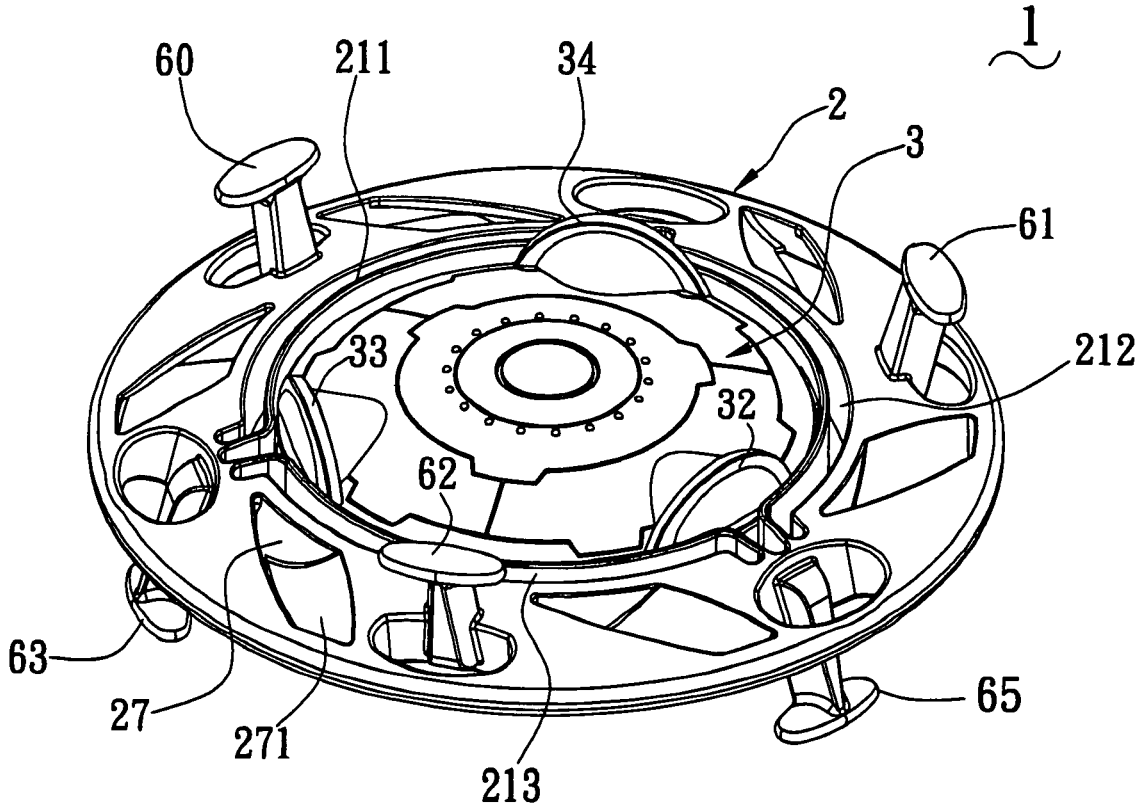
FIG. 2 is an assembled view of FIG. 1.
Figure 3:
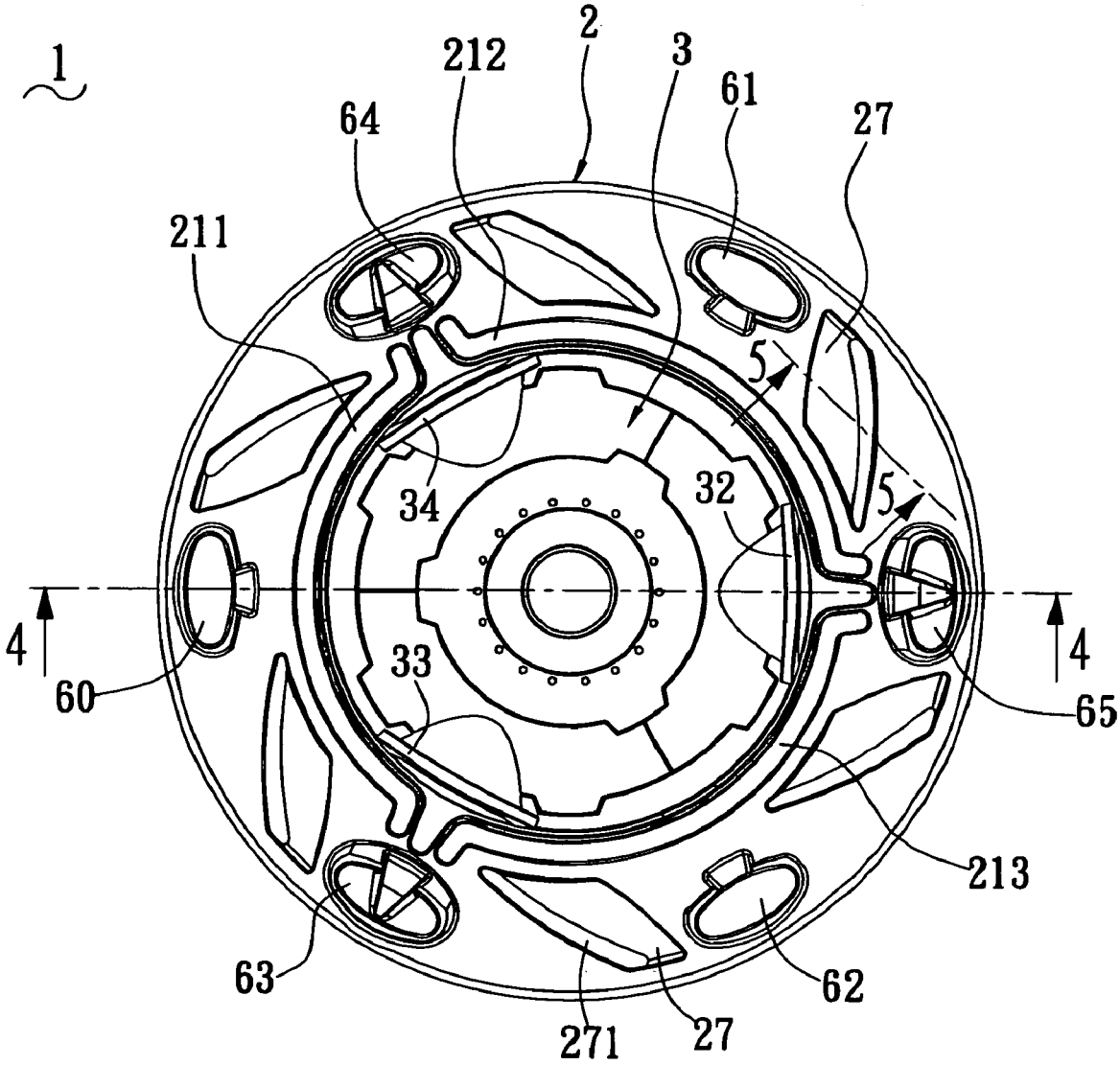
FIG. 3 is a top plan view of FIG. 2.
Figure 5:
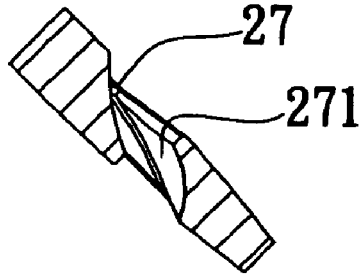
FIG. 5 is a cross-sectional view of FIG. 3 taken along line 5—5 in FIG. 3.
Figure 4:
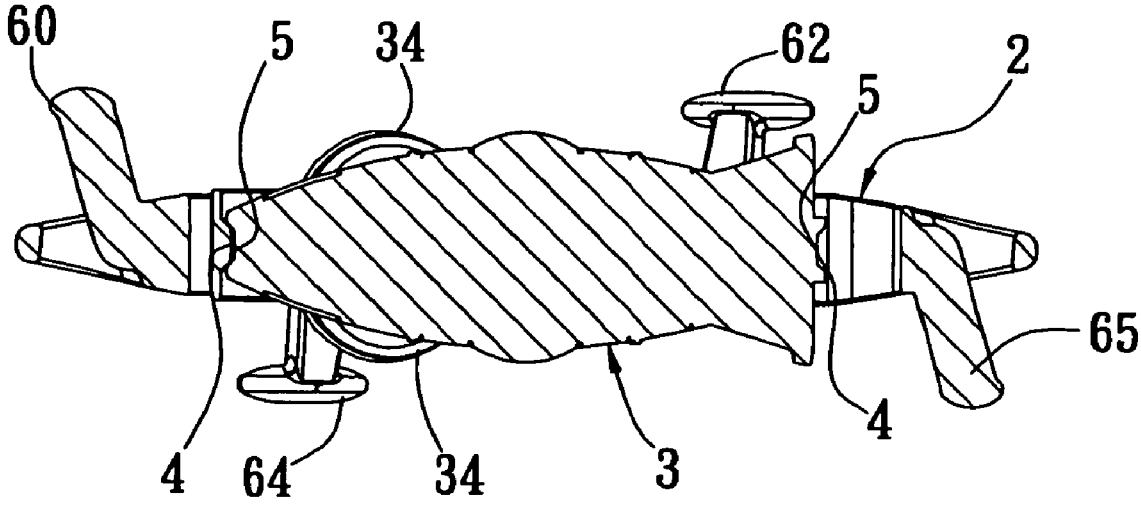
FIG. 4 is a cross-sectional view of FIG. 3 taken along line 4—4 in FIG. 3.

Referring to FIG. 1, an underwater fun toy 1 of the present invention includes a buoyant body 2, an underwater member 3, first and second engaging portions 4, 5 and a plurality of stand portions 6. The buoyant body 2 is made from floatable material. The buoyant body 2 may be in any symmetrical geometric shape. In this embodiment, the buoyant body 2 is circular with an upper surface 28 and a lower surface 29. The buoyant body 2 includes a receiving portion 20 and a buffering portion 21. The receiving portion 20 includes first, second and third receiving walls 201, 202, 203 extending between the upper and lower surface 28, 29, thereby defining a receiving opening. The receiving opening is large enough for extension of a hand and receives the underwater member 3 therein. A plurality of water guiding holes 27 is defined communicating through the upper and lower surface 28, 29 of the buoyant body 2. Referring to FIG. 5, a clockwise arcuate surface 271 is formed at the inner wall of each water guiding hole 27 for effectively guiding water whereby the buoyant body 2 floats gyrally.

The buffering portion 21 includes a first closed zone 211, a second closed zone 212, and a third closed zone 213, which are correspondingly adjacent to the first, second and third receiving walls 201, 202, 203 of the receiving portion 20. The closed zones 211, 212, 213 are defined between the upper and lower surface 28, 29 being hollow for providing a resilient space for the first, second and third receiving walls 201, 202, 203 in assembly.

The stand portions 6 respectively extend from the upper and lower surface 28, 29 of the buoyant body 2 and are evenly spaced. In this embodiment, the stand portions 6 includes three upper legs 60, 61, 62 at the upper surface 28 and three lower legs 63, 64, 65 at lower surface 29. The upper legs 60, 61, 62 are staggered and have the same height. Thus, when the underwater fun toy 1 is sank in water, such that stand portions 6 keeps the underwater fun toy 1 at a desired height above the bottom of water. The desired height is equal to the height of the stand portions 6 and is large enough to disengage the underwater member 3 from the buoyant body 2 whereby the buoyant body 2 floats on the water.

The underwater member 3 is in a flat cylindrical shape corresponding to the receiving portion 20 for being receivable in the receiving opening. The underwater member 3 is made from solid hard plastic or hollow hard plastic inside which material with a specific gravity thereof larger than that of water is filled. The underwater member 3 has first and second surfaces 30, 31. Three semicircular convexes 32, 33, 34 evenly spaced from each other respectively extend from the first and second surfaces 30, 31.

Referring to FIGS. 1 and 3–5, the first and second engaging portions 4, 5 are formed between the receiving portion 20 and the underwater member 3 and are engageable with each other. The first engaging portion 4 includes three rectangular protrusions respectively formed at the first, second and third receiving walls 201, 202, 203 of the receiving portion 20 corresponding to the upper legs 60, 61, 62. Each protrusion has upper and lower guiding surfaces for guiding the protrusion to engage with the second engaging portion 5. The second engaging portion 5 includes a recess on the peripheral surface of the underwater member 3. Opposite side surfaces of the recess are arcuate or slanting for facilitating to engage with the protrusions of the first engaging portion 4, whereby the first and second engaging portions 4, 5 are ready to engage or disengage. Furthermore, since the first engaging portion 4 is formed corresponding to the legs 60, 61, 62, when the underwater member 3 is depressed to disengage from the buoyant body 2, the legs 60, 61, 62 are supported by the bottom of the water to provide a counterforce to the first engaging portion 4 thereby facilitating to disengage the second engaging portion 5 from the first engaging portion 4.

Further referring to FIGS. 1 and 5, in assembly, the underwater member 3 is received in the receiving opening of the receiving portion 20 of the buoyant body 2 and connects to the buoyant body 2 through the engagement between the first and second engaging portions 4, 5. Thus, the assembled buoyant body 2 and underwater member 3 are sank in water and are kept a desired height above the bottom of the water through the stand portions 6.

Figure 6:
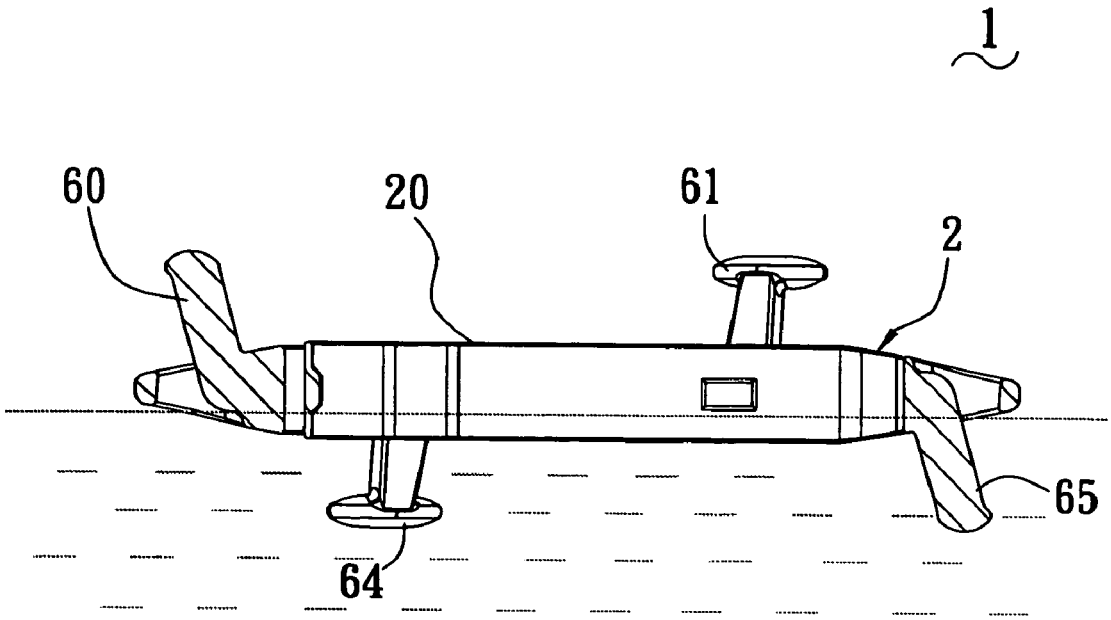
FIG. 6 is a schematic view showing a buoyant body floating on water after the buoyant body is disengaged from an underwater member.
Figure 6:
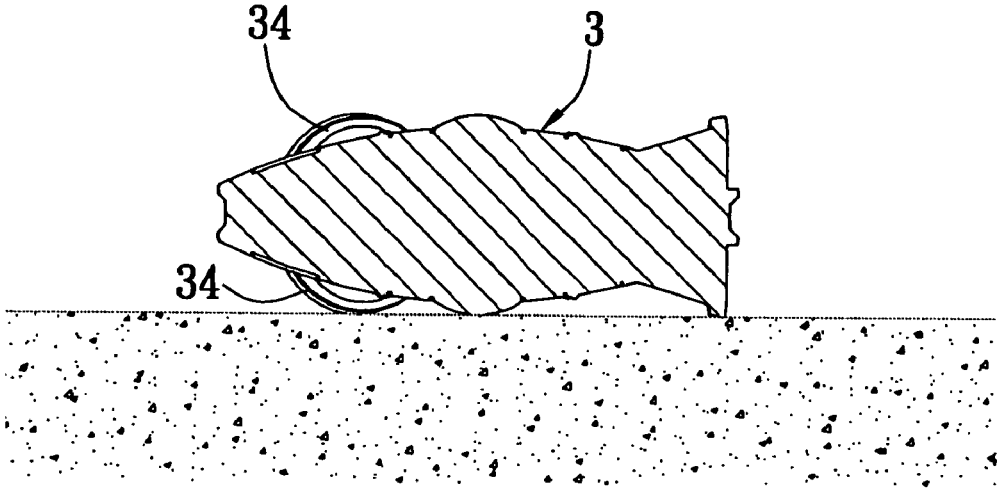

In use, the assembled underwater fun toy 1 is put underwater. Since the legs 60, 61, 62, 63, 64, 65 symmetrically project from the upper and lower surface 28, 29 with the desired height, the underwater fun toy 1 are kept the desired height from the bottom of the water whatever the upper surface 28 or the lower surface 29 faces the bottom of the water. Thus, players may dive into water from a start to look for the underwater fun toy 1 and the one first finding the underwater fun toy 1 may depress the underwater member 3 to disengage the second engaging portion 5 from the first engaging portion 4. Thus the buoyant body 2 gyrally floats on the surface of the water (see FIG. 6) through the water guiding holes 27 and the underwater member 3 is sank in water thereby to indicate the winner has come out. Therefore, the underwater fun toy 1 of the present invention can be used in a diving game and make the game funny thereby facilitating diving exercise.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An underwater fun toy for an aquatic game in water comprising:

a buoyant body having an upper and lower surface and a receiving portion communicating through the upper and lower surface;

an underwater member receivable in the receiving portion, having a first and second surface;

first engaging portions formed on the receiving portion;

second engaging portions formed on the underwater member being engageable or disengageable with the first engaging portions; and a plurality of stand portions for supporting the buoyant body which engages with the underwater member at a desired height from the bottom of water;

wherein in use the buoyant body engages the underwater member and sinks in water such that stand portions keeps the buoyant body at a desired height above the bottom of water, and when the underwater member is depressed to disengage from the buoyant body thereby said buoyant body floats to the surface of the water and the underwater member remains sunk, wherein the stand portions comprises three evenly spaced upper leas at the upper surface and three evenly spaced lower legs at the lower surface, and the upper and lower legs are staggered.

2. The underwater fun toy as claimed in claim 1, wherein the stand portions have the same height and respectively extend from the upper and lower surface of the buoyant body.

3. The underwater fun toy as claimed in claim 1, wherein a plurality of water guiding holes is defined communicating through the upper and lower surface of the buoyant body.

4. The underwater fun toy as claimed in claim 1, wherein the receiving portion comprises a first receiving wall, a second receiving wall and a third receiving wall, each of which extending between the upper and lower surface (28, 29), thereby defining a receiving opening.

5. The underwater fun toy as claimed in claim 4, wherein the buoyant body further comprises a buffering portion comprising a first, second and third closed zone which are respectively adjacent to and spaced apart from the first, second and third receiving wall of the receiving portion being hollow for providing a resilient space.

6. The underwater fun toy as claimed in claim 4, wherein the first engaging portion includes three evenly spaced protrusions respectively formed at the first, second and third receiving walls of the receiving portion.

7. The underwater fun toy as claimed in claim 6, wherein each protrusion is rectangular and has upper and lower guiding surfaces.

8. The underwater fun toy as claimed in claim 7, wherein the second engaging portion includes a recess on the peripheral surface of the underwater member, and opposite side surfaces of the recess are arcuate or slanted for facilitating engagement with the protrusions of the first engaging portion.

9. The underwater fun toy as claimed in claim 1, wherein the receiving portion is a symmetrical geometric shape.

10. The underwater fun toy as claimed in claim 9, wherein the underwater member is a symmetrical geometric shape corresponding to the shape of the receiving portion.

11. The underwater fun toy as claimed in claim 3, wherein a clockwise arcuate surface is formed at the inner wall of each water guiding hole for effectively guiding water whereby the buoyant body floats gyrally.

12. An underwater fun toy for an aquatic game in water comprising:

a buoyant body having an upper and lower surface and a receiving portion communicating through the upper and lower surface;

an underwater member receivable in the receiving portion, having a first and second surface;

first engaging portions formed on the receiving portion;

second engaging portions formed on the underwater member being engageable or disengageable with the first engaging portions; and a plurality of stand portions for supporting the buoyant body which engages with the underwater member at a desired height from the bottom of water;

wherein in use the buoyant body engages the underwater member and sinks in water such that stand portions keeps the buoyant body at a desired height above the bottom of water, and when the underwater member is depressed to disengage from the buoyant body thereby said buoyant body floats to the surface of the water and the underwater member remains sunk, wherein the stand portions comprises three evenly spaced upper legs at the upper surface and three evenly spaced lower legs at the lower surface, and the upper and lower legs are staggered, wherein three semicircular convexes evenly spaced from each other respectively extend from the first and second surfaces.

* * * * *